US009783344B2

(12) United States Patent
Vournou et al.

(10) Patent No.: US 9,783,344 B2
(45) Date of Patent: Oct. 10, 2017

(54) UNIVERSAL BOTTLE CAP ASSEMBLY

(71) Applicants: Antonios Vournou, Syosset, NY (US); Stella E. Tsimis, Nesconset, NY (US)

(72) Inventors: Antonios Vournou, Syosset, NY (US); Stella E. Tsimis, Nesconset, NY (US)

( * ) Notice: Subject to any disclaimer, the term of this patent is extended or adjusted under 35 U.S.C. 154(b) by 15 days.

(21) Appl. No.: 14/832,300

(22) Filed: Aug. 21, 2015

(65) Prior Publication Data

US 2017/0050770 A1 Feb. 23, 2017

(51) Int. Cl.
*B65D 41/00* (2006.01)
*B65D 41/02* (2006.01)
*B65D 47/06* (2006.01)

(52) U.S. Cl.
CPC ..... *B65D 41/02* (2013.01); *B65D 47/06* (2013.01); *B65D 2251/08* (2013.01)

(58) Field of Classification Search
CPC .... B65D 71/502; B65D 77/283; B65D 77/28; B65D 77/24; A47G 19/22
USPC ..... 215/316
See application file for complete search history.

(56) References Cited

U.S. PATENT DOCUMENTS 1,213,319 A * 1/1917 Whitaker ..... B65D 39/16 215/308
2,881,953 A * 4/1959 Kuschel ..... B65D 35/24 141/383
3,156,272 A * 11/1964 Indrunas ..... B65D 81/3205 141/286
3,217,917 A * 11/1965 George ..... F16L 47/16 141/363
3,266,533 A * 8/1966 McHale ..... B65D 71/502 141/234
3,615,150 A * 10/1971 Indrunas ..... B65D 71/502 141/364
4,201,252 A * 5/1980 Noel ..... B65B 3/06 141/286
4,347,879 A * 9/1982 Blaser ..... B65D 71/502 141/364
4,625,780 A * 12/1986 Burnham ..... B65D 71/502 138/44
5,000,236 A * 3/1991 Jemison ..... B65D 71/502 141/114
5,513,762 A * 5/1996 Janani ..... B65D 77/283 215/229

(Continued)

OTHER PUBLICATIONS

PCT International Search Report and Written Opinion for PCT/US16/48038 dated Sep. 16, 2016.

*Primary Examiner* — Anthony Stashick
*Assistant Examiner* — Ernesto Grano
(74) *Attorney, Agent, or Firm* — Carter, DeLuca, Farrell & Schmidt, LLP; George Likourezos, Esq.

(57) ABSTRACT

A universal bottle cap assembly includes a housing having a cavity therein, a cap insert, and a dispensing member. The housing defining an opening configured to provide access to the cavity therein. The cap insert extends between a first portion and a second portion, each of the first and second portions of the cap insert including a plurality of concentric sleeves configured to enclose a beverage container, wherein the cap insert is configured to be disposed within the cavity of the housing. The dispensing member extends through the cap insert and includes a hollow body configured to provide a free flow of materials therethrough.

29 Claims, 5 Drawing Sheets

(56) References Cited

U.S. PATENT DOCUMENTS 5,642,763 A * 7/1997 Kurtz ..... B65D 71/502 141/319
5,884,678 A * 3/1999 Chudy ..... B65B 3/04 141/319
6,182,720 B1 * 2/2001 Barnoski ..... B65B 3/06 141/364
6,382,439 B1 * 5/2002 Belokin ..... A63B 21/0602 206/459.5
6,457,899 B1 * 10/2002 Lin ..... G09B 23/12 141/319
6,540,726 B1 * 4/2003 Follman ..... B65D 41/62 604/294
6,547,159 B1 * 4/2003 Westby ..... B05B 15/06 239/204
6,820,772 B1 * 11/2004 Bennett, Jr. ..... B67D 3/048 222/185.1
6,910,720 B2 * 6/2005 Shimei ..... A61J 1/2089 285/331
6,962,254 B2 11/2005 Spector
7,210,508 B2 * 5/2007 Behar ..... A45D 34/02 141/319
7,431,437 B2 * 10/2008 Wilson, II ..... B41J 2/17506 347/85
7,685,766 B2 * 3/2010 Amsellem ..... A01G 29/00 47/48.5
8,083,055 B2 12/2011 Simonian et al.
8,215,481 B1 * 7/2012 Knickerbocker .... B65D 51/285 206/219
8,251,110 B2 * 8/2012 Bassett ..... A47K 5/12 141/319
8,302,770 B2 11/2012 Valentine
8,313,644 B2 * 11/2012 Harris ..... C02F 1/002 210/198.1
8,925,593 B2 * 1/2015 Lamboux ..... A45D 34/02 141/18
9,145,245 B1 * 9/2015 Visser ..... F16L 15/06
2003/0192894 A1 * 10/2003 Munns ..... B65D 1/04 220/505
2005/0205159 A1 * 9/2005 Foust ..... B65D 71/502 141/319
2007/0012693 A1 * 1/2007 Kummer ..... B65D 43/0231 220/4.27
2007/0277902 A1 * 12/2007 Dieudonat ..... B05B 11/0097 141/319
2008/0173610 A1 * 7/2008 Esposito ..... B65D 77/283 215/227
2012/0160851 A1 * 6/2012 Chiang ..... B65D 47/066 220/360
2012/0234432 A1 * 9/2012 Lamboux ..... B65B 39/003 141/2

* cited by examiner

UNIVERSAL BOTTLE CAP ASSEMBLY

BACKGROUND

1. Technical Field

The present disclosure relates to bottle caps, and more particularly, to bottle caps configured for universally retrofitting pre-existing beverage containers.

2. Background of Related Art

A majority of the bottle caps used in the beverage and beverage packaging industry employ a screw and thread configuration. Presently, the containers used for beverages such as, for example, water, soda, juice, and sports drinks, vary in size and shape. As such, each of these containers utilizes bottle caps and closure systems also varying in sizes and shapes to threadably engage the various containers.

Typically, a beverage container includes a bottle cap or closure system sized for that particular beverage container.

However, it would be advantageous to provide a bottle cap assembly capable of being retrofitted onto a plurality of beverage containers having various sizes. It would also be advantageous to provide a bottle cap assembly having an outlet for dispensing a liquid.

SUMMARY

The present disclosure provides in one aspect a universal bottle cap assembly having a housing having a cavity, a cap insert, and a dispensing member. The housing defines an opening configured to provide access to the cavity therein. The cap insert extends between a first portion and a second portion, each of the first and second portions of the cap insert including a plurality of concentric sleeves configured to enclose a beverage container, wherein the cap insert is configured to be disposed within the cavity of the housing.

In embodiments, the dispensing member extends through the cap insert and includes a hollow body configured to provide a free flow of materials therethrough.

In some embodiments, the cavity of the housing includes a threaded inner surface and the cap insert includes a threaded outer surface, wherein the threaded outer surface of the cap insert is configured to engage the threaded inner surface of the housing when the cap insert is disposed within the cavity of the housing.

In certain embodiments, the housing extends between a distal portion and a proximal portion, the proximal portion of the housing defining the opening therethrough configured to provide access to the cavity of the housing.

In embodiments, the distal portion of the housing includes an outer surface defining a first aperture therethrough, the first aperture configured to locate the dispensing member when the cap insert is disposed within the cavity of the housing.

In some embodiments, the first portion of the cap insert includes a first outer sleeve and a first inner sleeve concentrically disposed within the first outer sleeve, wherein the first outer sleeve includes a plurality of tabs extending towards the first inner sleeve and the first inner sleeve includes a threaded inner portion.

In certain embodiments, the first outer sleeve includes a first diameter and the first inner sleeve includes a second diameter, wherein the first diameter of the first outer sleeve is greater than the second diameter of the first inner sleeve.

In embodiments, the second portion of the cap insert includes a second outer sleeve and a second inner sleeve concentrically disposed within the second outer sleeve, wherein each of the second outer sleeve and the second inner sleeve includes a threaded inner portion.

In some embodiments, the second outer sleeve includes a third diameter and the second inner sleeve includes a fourth diameter, wherein the third diameter of the second outer sleeve is greater than the fourth diameter of the second inner sleeve.

In certain embodiments, the first diameter of the first outer sleeve is equal to the third diameter of the second outer sleeve and the second diameter of the first inner sleeve is less than the fourth diameter of the second inner sleeve.

In embodiments, the cap insert includes a common wall dissecting a body of the cap insert, wherein the first outer sleeve, the first inner sleeve, the second outer sleeve, and the second inner sleeve are coupled together at the common wall of the cap insert.

In some embodiments, the common wall of the cap insert includes a second aperture configured to locate the dispensing member.

In certain embodiments, the dispensing member includes a gasket portion and the second aperture of the common wall includes a perimeter, wherein the gasket portion of the dispensing member is configured to surround the perimeter of the second aperture to prevent unwanted flow of material between the first and second portions of the cap insert.

In embodiments, the hollow body of the dispensing member extends between a first dispensing opening and a second dispensing opening, the first and second dispensing openings of the hollow body having a beveled configuration.

In some embodiments, the second aperture defined in the common wall of the cap insert is aligned with the first aperture defined in the distal portion of the housing when the cap insert is disposed within the cavity of the housing.

In certain embodiments, the threaded outer surface of the cap insert includes a first leading thread on the first portion of the cap insert and a second leading thread on the second portion of the cap insert such that the cap insert is locatable within the cavity of the housing, threadably leading with the first portion of the cap insert or the second portion of the cap insert.

In embodiments, the housing further includes a cover pivotably located on the distal portion of the housing, wherein the cover is configured to selectively enclose the distal portion of the housing.

In some embodiments, the universal bottle cap assembly includes a straw configured to couple to the dispensing member.

In certain embodiments, the cap insert is monolithic.

In embodiments, the dispensing member is constructed from silicone.

The present disclosure provides in another aspect a kit including a universal bottle cap assembly having a housing having a cavity therein, a cap insert, a dispensing member, and a straw. The housing defines an opening configured to provide access to the cavity therein. The cap insert extends between a first portion and a second portion, each of the first and second portions of the cap insert including a plurality of concentric sleeves configured to enclose a beverage container, wherein the cap insert is configured to be disposed within the cavity of the housing. The dispensing member extends through the cap insert and includes a hollow body configured to provide a free flow of materials therethrough.

BRIEF DESCRIPTION OF THE DRAWINGS

Various embodiments of the presently disclosed universal bottle cap assembly are described herein below with reference to the drawings, wherein.

DETAILED DESCRIPTION OF EMBODIMENTS

Figure 1:
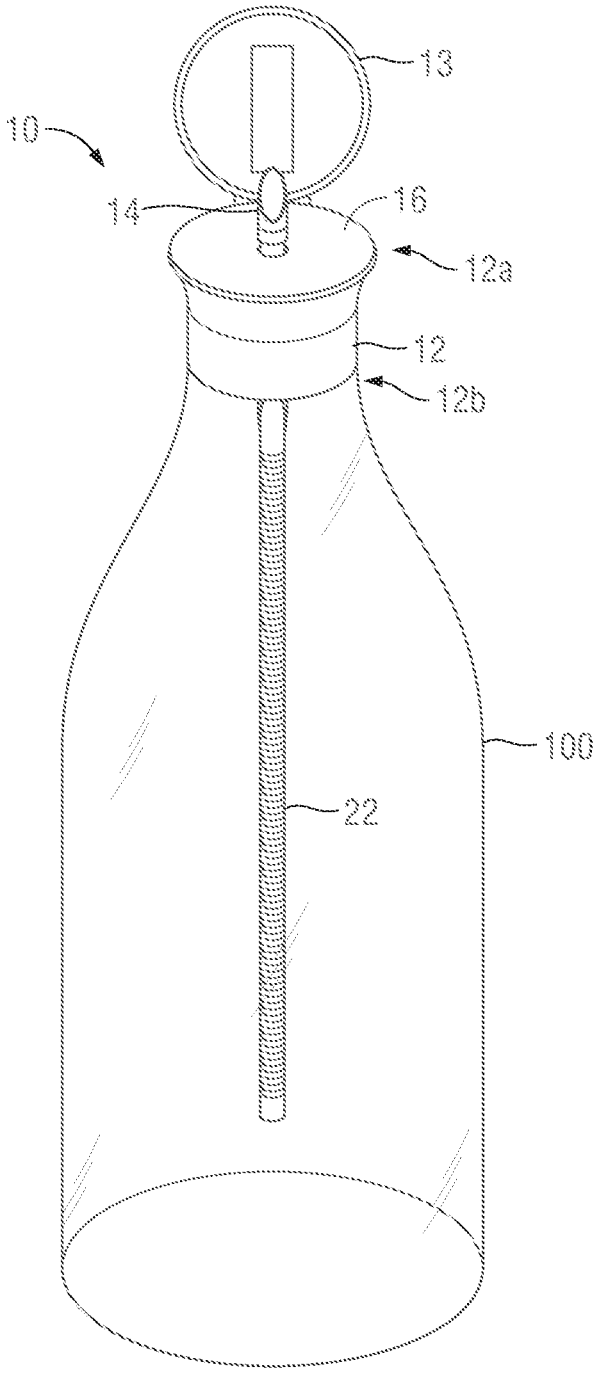
FIG. 1 is a front view of a universal bottle cap assembly in an assembled configuration and applied to a beverage container, in accordance with an embodiment of the present disclosure.

The presently disclosed universal bottle cap assembly will now be described in detail with reference to the drawings in which like reference numerals designate identical or corresponding elements in each of the several views. Throughout this description, the term "proximal" will refer to the portion of the assembly closer to the operator and the term "distal" will refer to the portion of the assembly further from the operator.

The exemplary embodiments of the universal bottle cap assembly are disclosed and discussed in terms of a device for enclosing and dispensing liquids from a beverage container having a screw and thread closure system. However, it should be appreciated that the present disclosure may be used with a wide range of containers having a plurality of closure systems.

FIG. 1 illustrates one embodiment of the presently disclosed universal bottle cap assembly 10 enclosing a beverage container 100. Briefly, the universal bottle cap assembly 10 includes a housing 12 and a dispensing member 14 extending therethrough.

Figure 2:
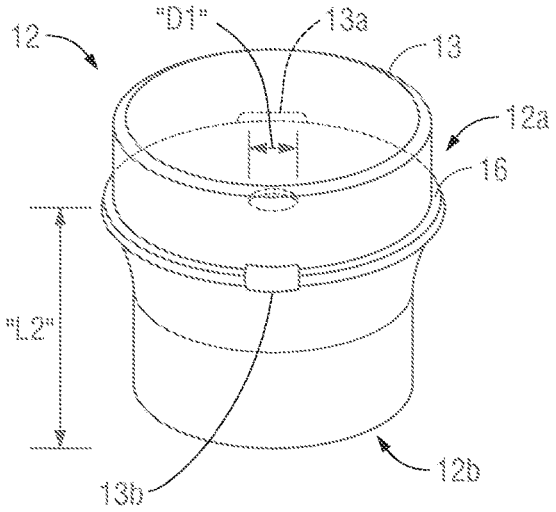
FIG. 2 is a front perspective view of a housing including a cover of the presently disclosed universal bottle cap assembly.
Figure 3:
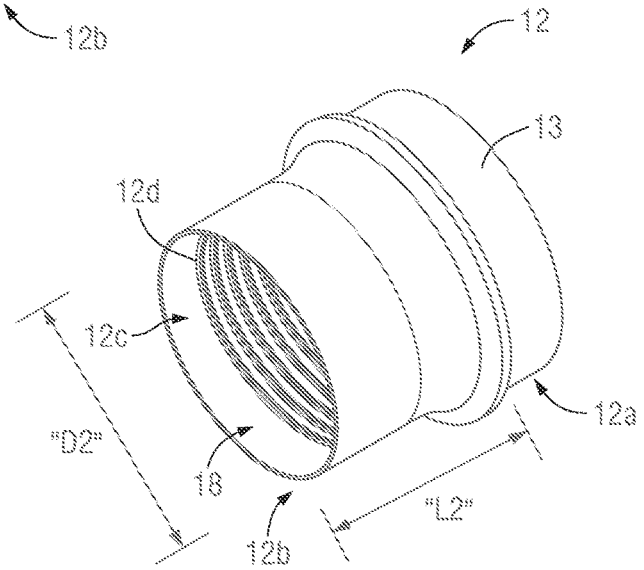
FIG. 3 is a back perspective view of the housing of FIG. 2 of the present disclosure.

With additional reference to FIGS. 2 and 3, an embodiment of the housing 12 is shown. Housing 12 includes a distal portion 12*a* having an outer surface 16. Outer surface 16 of distal portion 12*a* defines an aperture 16*a* therethrough. In embodiments, aperture 16 includes a diameter "D1" configured for locating a portion of the dispensing member 14, as shown in FIG. 1.

Housing 12 also includes a proximal portion 12*b* defining an opening 18 therethrough. In embodiments, opening 18 includes a diameter "D2" configured for accessing a cavity 12*c* of housing 12. Cavity 12*c* includes a threaded inner surface 12*d* configured for engaging a cap insert 20, as will be discussed in greater detail below. As shown in FIGS. 2 and 3, housing 12 may be cylindrically shaped. However, it is contemplated that housing 12 may be any suitable shape intended for its purpose.

Housing 12 also includes a cover 13 configured to enclose a portion of the dispensing member 14 when the universal bottle cap assembly 10 is not in use. As shown in FIG. 3, cover 13 is pivotably coupled to housing 12 at a pivot point 13*a*. In embodiments, cover 13 includes a locking mechanism 13*b* configured to selectively secure cover 13 to housing 12 such that the dispensing member 14 is not exposed to the outside environment when the universal bottle cap assembly 10 is not in use.

Figure 4:
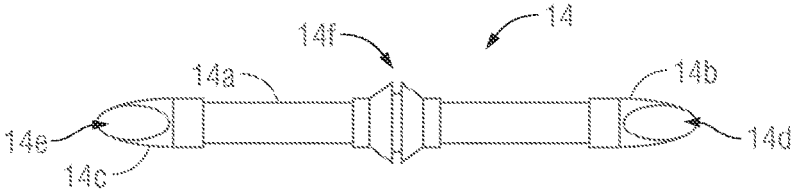
FIG. 4 is a front view of a dispensing member of the present disclosure.

With brief reference to FIG. 4, an embodiment of the dispensing member 14 is shown. Dispensing member 14 includes a hollow body 14*a* extending longitudinally between a first end 14*b* and a second end 14*c*. First end 14*b* includes a first dispensing opening 14*d* and second end 14*c* includes a second dispensing opening 14*e*. The first and second dispensing openings 14*d* and 14*e* are configured to provide free flow of materials through the hollow body 14*a* of the dispensing member 14. As shown in FIG. 1, the second dispensing opening 14*e* is configured to be attached to a straw 22 to extend the reach of the dispensing member 14. Similarly, it is also contemplated that the first dispensing opening 14*d* is also configured to be attached to straw 22. In embodiments, the first and second dispensing openings 14*d* and 14*e* are beveled, though other configurations, such as, for example, circular are also contemplated.

As will be discussed below, dispensing member 14 is configured to extend through an aperture 24 defined in the cap insert 20 (see FIG. 7). To that end, the dispensing member 14 includes a gasket portion 14*f* located on the body 14*a*. It is contemplated that the gasket portion 14*f* is configured to surround a perimeter "P" of the aperture 24 to prevent unwanted flow of material through the cap insert 20 through the perimeter "P" of aperture 24. In embodiments, aperture 24 of the cap insert 20 is aligned with the aperture 16*a* of the distal portion 12*a* of the housing 12 when the cap insert 20 is disposed within the cavity 12*c* of the housing 12.

Figure 5:
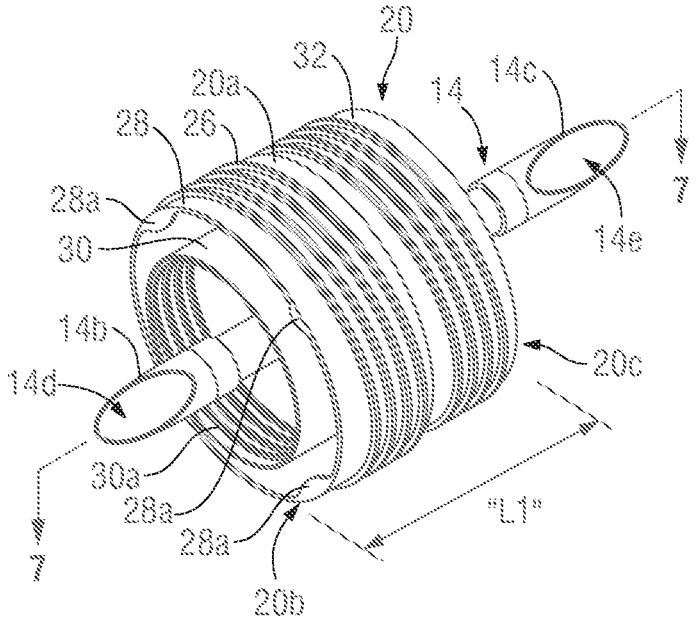
FIG. 5 is a front perspective view of a cap insert including the dispensing member of the present disclosure.
Figure 6:
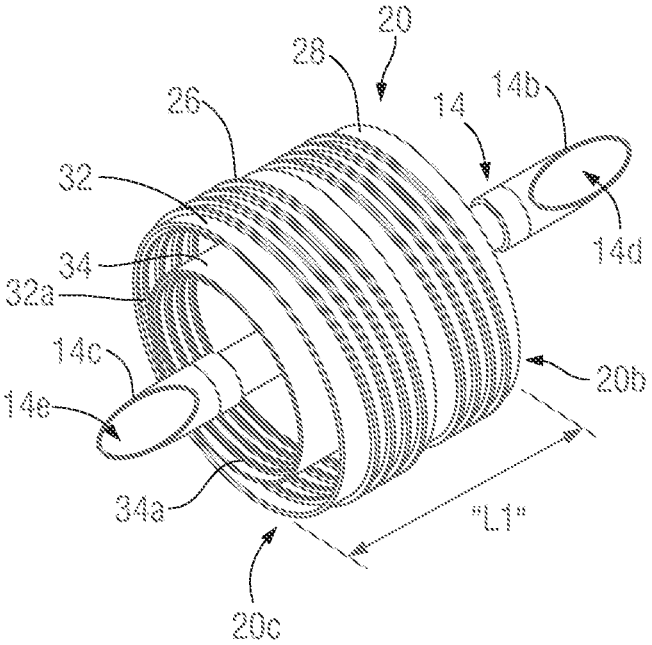
FIG. 6 is a back perspective view of a cap insert including the dispensing member of the present disclosure.
Figure 7:
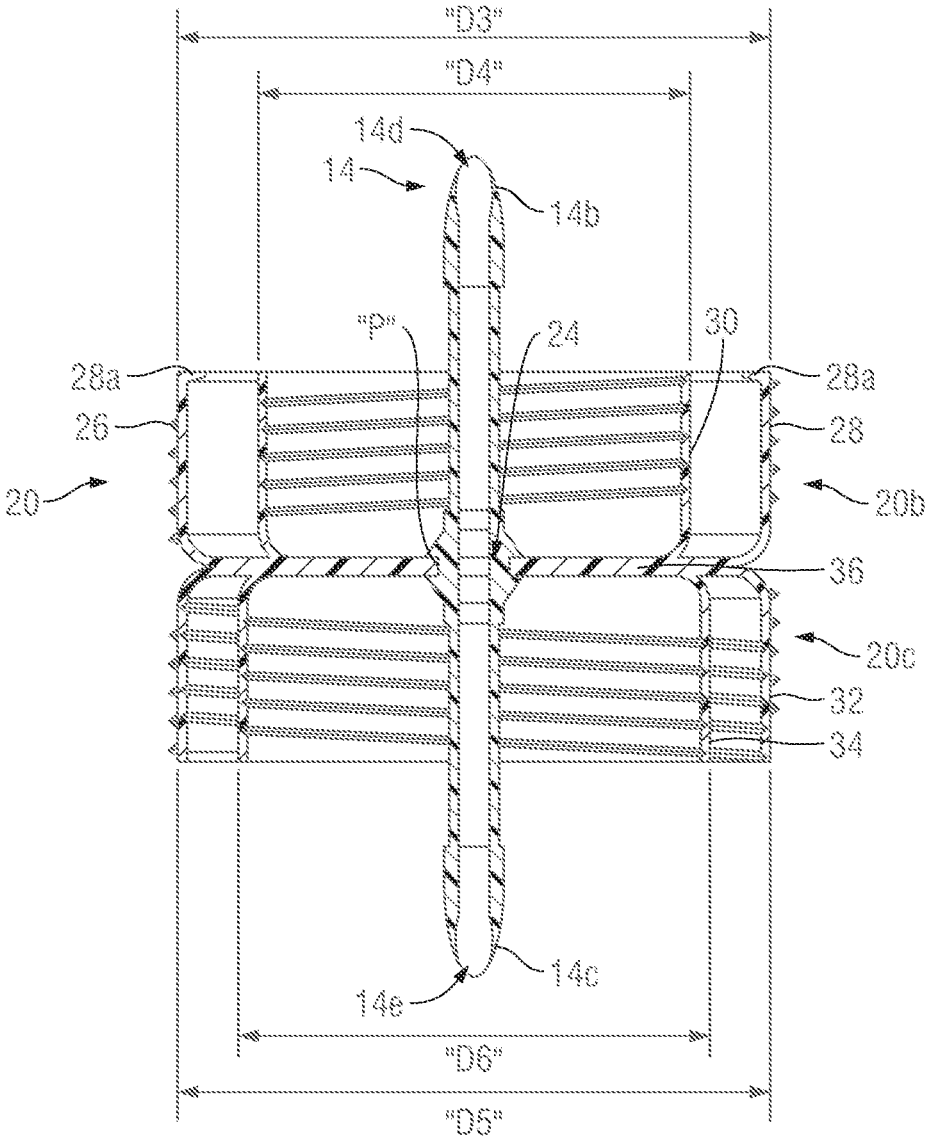
FIG. 7 is a cross-sectional view of the cap insert including the dispensing member taken along section line 7-7 of FIG. 5.

Turning now to FIGS. 5-7, an embodiment of cap insert 20 is shown with the dispensing member 14 extending therethrough. Cap insert 20 includes a body 20*a* extending between a first portion 20*b* and a second portion 20*c*. The body portion 20*a* of cap insert 20 includes a threaded outer surface 26. In embodiments, the threaded outer surface 26 of cap insert 20 extends along a length "L1" of the body portion 20*a*. However, in alternative embodiments, the threaded outer surface 26 of cap insert 20 may only extend along a portion of the length "L1" of the body portion 20*a*.

With brief reference to FIGS. 2 and 3, the body 12*a* of housing 12 defines a length "L2" wherein the length "L1" of the cap insert 20 is equal to the length "L2" of the housing 12. Similar to the cap insert 20, the threaded inner surface 12*d* of the housing 12 may extend along the length "L2" of the housing 12 or alternatively, may extend along only a portion of the length "L2" of the housing 12. As disclosed above, the threaded inner surface 12*d* of the housing 12 is configured to engage the cap insert 20. In particular, the threaded inner surface 12*d* of the housing 12 is configured to engage the threaded outer surface 26 of the cap insert 20. In embodiments, the threaded outer surface 26 includes a first leading thread 26*a* on the first portion 20*b* of the cap insert 20 and includes a second leading thread 26*b* on the second portion 20*c* of the cap insert 20. As such, it is contemplated that both the first and second portions 20*b* and 20*c* of the cap insert 20 are configured to lead when the cap insert 20 threadably engages the threaded inner surface 12*d* of the housing 12.

Turning back to FIGS. 5-7, the first portion 20*b* of the cap insert 20 includes a first outer sleeve 28 and a first inner sleeve 30. Similarly, the second portion 20*c* of the cap insert 20 includes a second outer sleeve 32 and a second inner sleeve 34. Even though the first and second portions 20*a* and 20*b* of the cap insert 20 are shown to each have two sleeves, it is contemplated that the first and second portions 20*a* and 20*b* of the cap insert 20 may each have less than two sleeves or more than two sleeves. Further, it is contemplated that the number of sleeves may vary between the first and second portions 20*a* and 20*b* of the cap insert 20.

As shown in FIG. 7, the plurality of sleeves 28, 30, 32, and 34 of cap insert 20 are concentric. The plurality of sleeves 28, 30, 32, and 34 also share, and are coupled together at a common wall 36 dissecting the body 20*a*. The aperture 24, through which the dispensing member 14 extends, is defined on the common wall 36. It is contemplated that the plurality of sleeves 28, 30, 32, and 34 of cap insert 20 are configured to enclose various beverage containers, such as, for example, POLAND SPRING®, SNAPPLE®, PEPSICO®, GATORADE®, and COCA-COLA®. As such, the plurality of sleeves of the cap insert 20 may include various dimensions and configurations.

For example, in embodiments, the first outer sleeve 28 includes a diameter "D3," the first inner sleeve 30 includes a diameter "D4," the second outer sleeve 32 includes a diameter "D5," and the second inner sleeve 34 includes a diameter "D6". In embodiments, the diameter "D3" of the first outer sleeve is greater than the diameter "D4" of the first inner sleeve. In embodiments, the diameter "D3" of the first outer sleeve 28 is equal to the diameter "D5" of the second outer sleeve 32. In embodiments, the diameter "D5" of the second outer sleeve is greater than the diameter "D6" of the second inner sleeve. In embodiments, the diameter "D4" of the first inner sleeve 30 is less than the diameter "D6" of the second inner sleeve 34.

To accommodate for the various beverage containers, the plurality of sleeves also include various configurations. For example, the first outer sleeve 28 includes a plurality of tabs 28*a* configured to engage a plurality of grooves (not shown) of an embodiment of the beverage container 100. In embodiments, the plurality of tabs 28*a* of the first outer sleeve 28 extend towards the first inner sleeve 30.

Similarly, first inner sleeve 30, second outer sleeve 32, and second inner sleeve 34 each include a treaded inner portion 30*a*, 32*a*, and 34*a*, respectively, to engage a plurality of threads (not shown) of an embodiment of the beverage container 100. Notwithstanding the embodiments shown in FIGS. 5-7, it is contemplated that the plurality of sleeves 28, 30, 32, and 34 of the cap insert 20 may include other configurations, as required to engage other embodiments of the beverage container 100.

In constructing the universal bottle cap assembly 10, it is contemplated that any suitable materials such as metals and polymers may be used. For example, in embodiments, the dispensing member 14 may be constructed using silicone or other suitable materials. In embodiments, the universal bottle cap assembly 10 may be injection molded such that the cap insert 20 is monolithic. However, it is contemplated that the universal bottle cap assembly 10 may also be machined.

With reference to FIGS. 1-7, in operation, when a user intends on using the universal cap assembly 10, the user removes the preexisting bottle cap (not shown) from the beverage container 100. Depending on the embodiment of the beverage container 100, the user chooses between the first outer sleeve 28, the first inner sleeve 30, the second outer sleeve 32, or the second inner sleeve 34. Having attached the straw 22 to either the first or the second end 14*b*, 14*c* of the dispensing member 14, the user applies the cap insert 20 to the beverage container 100 to enclose the beverage container 100. Next, the user applies the housing 12 and threadably fixes the housing 12 to the cap insert 20 making sure that a portion of the dispensing member 14 extends through aperture 16*a* of the housing 12. The user then actuates the locking mechanism 13*b* and the cover 13 rotates about the pivot point 13*a* with respect to the housing 12 to provide access to the dispensing member 14.

Figure 8:
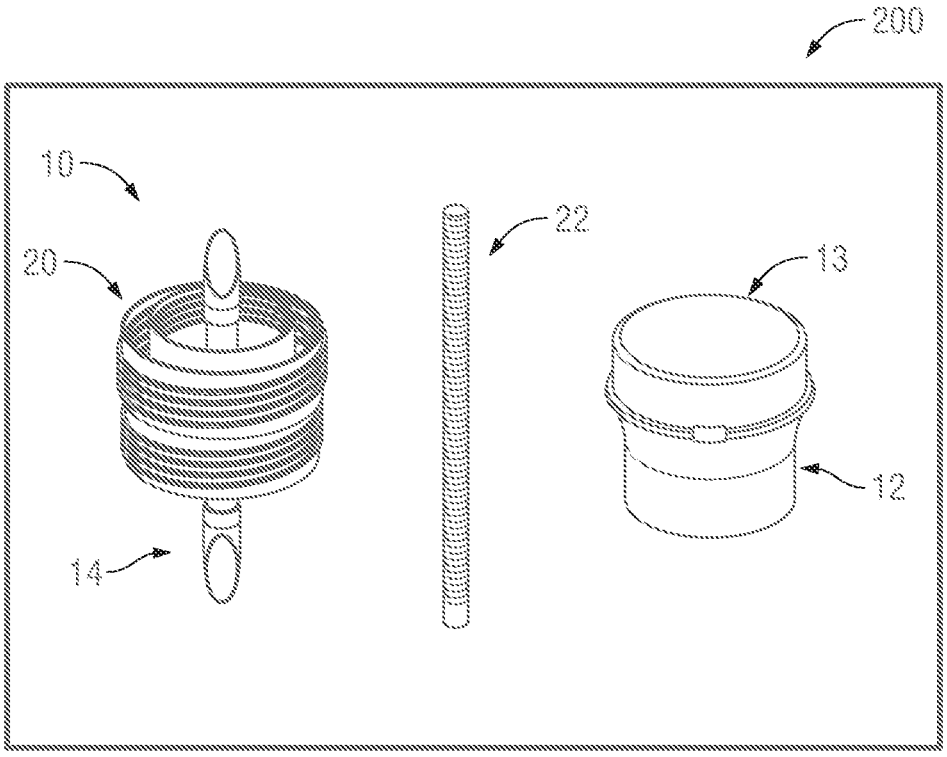
FIG. 8 is a kit including the universal bottle cap assembly of FIG. 1.

In accordance with the present disclosure, it is further contemplated that a universal bottle cap assembly kit 200 (see FIG. 8) may be provided including the universal bottle cap assembly 10. In particular, the kit 200 would include the cap insert 20 having the dispensing member 14 extending therethrough and the housing 12 having the cover 13 pivotably attached thereto. In embodiments, the kit may include the straw 22. In embodiments, kit 200 may also include instructions for the assembly of the universal bottle cap assembly 10, the use of the universal bottle cap assembly 10, and a package, container or box configured to retain the same.

Persons skilled in the art will understand that the devices and methods specifically described herein and illustrated in the accompanying drawings are non-limiting exemplary embodiments. It is envisioned that the elements and features illustrated or described in connection with one exemplary embodiment may be combined with the elements and features of one or more embodiments without departing from the scope of the present disclosure. As well, one skilled in the art will appreciate further features and advantages of the disclosure based on the above-described embodiments. Accordingly, the disclosure is not to be limited by what has been particularly shown and described, except as indicated by the appended claims.

What is claimed is:

1. A universal bottle cap assembly comprising:

a housing having a cavity, the housing defining an opening configured to provide access to the cavity therein; and a cap insert extending between a first portion and a second portion, the first and second portions of the cap insert each including a plurality of concentric sleeves configured to enclose a portion of a beverage container, wherein the cap insert is configured to be disposed within the cavity of the housing through the opening therein, wherein the first portion of the cap insert includes a first outer sleeve and a first inner sleeve concentrically disposed within the first outer sleeve; wherein the cavity of the housing includes a threaded inner surface and the cap insert includes a threaded outer surface, wherein the threaded outer surface of the cap insert is configured to engage the threaded inner surface of the housing when the cap insert is disposed within the cavity of the housing.

2. The universal bottle cap assembly of claim 1, further including a dispensing member extending through the cap insert, the dispensing member having a hollow body configured to provide a free flow of materials therethrough.

3. The universal bottle cap assembly of claim 2, wherein the housing extends between a distal portion and a proximal portion, the proximal portion of the housing including the opening configured to provide access to the cavity of the housing.

4. The universal bottle cap assembly of claim 3, wherein the distal portion of the housing includes an outer surface defining a first aperture therethrough, the first aperture configured to locate the dispensing member when the cap insert is disposed within the cavity of the housing.

5. The universal bottle cap assembly of claim 1, wherein the first outer sleeve includes a plurality of tabs extending towards the first inner sleeve and the first inner sleeve includes a threaded inner portion.

6. The universal bottle cap assembly of claim 1, wherein the first outer sleeve includes a first diameter and the first inner sleeve includes a second diameter, wherein the first diameter of the first outer sleeve is greater than the second diameter of the first inner sleeve.

7. The universal bottle cap assembly of claim 1, wherein the second portion of the cap insert includes a second outer sleeve and a second inner sleeve concentrically disposed within the second outer sleeve, wherein each of the second outer sleeve and the second inner sleeve includes a threaded inner portion.

8. The universal bottle cap assembly of claim 7, wherein the second outer sleeve includes a third diameter and the second inner sleeve includes a fourth diameter, wherein the third diameter of the second outer sleeve is greater than the fourth diameter of the second inner sleeve.

9. The universal bottle cap assembly of claim 8, wherein the first diameter of the first outer sleeve is equal to the third diameter of the second outer sleeve and the second diameter of the first inner sleeve is less than the fourth diameter of the second inner sleeve.

10. The universal bottle cap assembly of claim 8, wherein the cap insert includes a common wall dissecting a body of the cap insert, wherein the first outer sleeve, the first inner sleeve, the second outer sleeve, and the second inner sleeve are coupled together at the common wall of the cap insert.

11. The universal bottle cap assembly of claim 2, wherein a wall of the cap insert defines a second aperture configured to locate the dispensing member therethrough.

12. The universal bottle cap assembly of claim 11, wherein the dispensing member includes a gasket portion and the second aperture of the common wall includes a perimeter, wherein the gasket portion of the dispensing member is configured to surround the perimeter of the second aperture to prevent unwanted flow of material between the first and second portions of the cap insert.

13. The universal bottle cap assembly of claim 2, wherein the hollow body of the dispensing member extends between a first dispensing opening and a second dispensing opening, the first and second dispensing openings of the hollow body having a beveled configuration.

14. The universal bottle cap assembly of claim 11, wherein the second aperture defined in the wall of the cap insert is aligned with a first aperture defined in a distal portion of the housing when the cap insert is disposed within the cavity of the housing.

15. The universal bottle cap assembly of claim 1, wherein the threaded outer surface of the cap insert includes a first leading thread on the first portion of the cap insert and a second leading thread on the second portion of the cap insert such that the cap insert is locatable within the cavity of the housing, threadably leading with the first portion of the cap insert or the second portion of the cap insert.

16. The universal bottle cap assembly of claim 1, wherein the housing further includes a cover pivotably located on the distal portion of the housing, wherein the cover is configured to selectively enclose the distal portion of the housing.

17. The universal bottle cap assembly of claim 2, further including a straw configured to couple to the dispensing member.

18. The universal bottle cap assembly of claim 1, wherein the cap insert is monolithic.

19. The universal bottle cap assembly of claim 2, wherein the dispensing member is silicone.

20. A kit including a universal bottle cap assembly, the kit comprising:

a housing having a cavity, the housing defining an opening configured to provide access to the cavity therein;

a cap insert extending between a first portion and a second portion, the first and second portions of the cap insert each including a plurality of concentric sleeves configured to enclose a portion of a beverage container, wherein the cap insert is configured to be disposed within the cavity of the housing through the opening therein, wherein the cavity of the housing includes a threaded inner surface and the cap insert includes a threaded outer surface;

a dispensing member extending through the cap insert, the dispensing member having a hollow body configured to provide a free flow of materials therethrough; and a straw configured to couple to the dispensing member.

21. A universal bottle cap assembly comprising:

a housing having a cavity including a threaded inner surface, the housing defining an opening configured to provide access to the cavity therein; and a cap insert extending between a first portion and a second portion, the cap insert including a threaded outer surface configured to engage the threaded inner surface of the housing, the first and second portions of the cap insert each including a plurality of concentric sleeves configured to enclose a portion of a beverage container, wherein the cap insert is configured to be disposed within the cavity of the housing through the opening therein, wherein the threaded outer surface of the cap insert includes a first leading thread on the first portion of the cap insert and a second leading thread on the second portion of the cap insert such that the cap insert is locatable within the cavity of the housing, threadably leading with the first portion of the cap insert or the second portion of the cap insert.

22. The universal bottle cap assembly of claim 21, wherein the housing further includes a cover pivotably located on the distal portion of the housing, wherein the cover is configured to selectively enclose the distal portion of the housing.

23. A universal bottle cap assembly comprising:

a housing having a cavity, the housing defining an opening configured to provide access to the cavity therein; and a cap insert extending between a first portion and a second portion, the first portion of the cap insert including a first outer sleeve having a first diameter and a first inner sleeve concentrically disposed within the first outer sleeve and including a second diameter, the first diameter of the first outer sleeve being greater than the second diameter of the first inner sleeve, wherein the first outer sleeve includes a plurality of tabs extending towards the first inner sleeve and the first inner sleeve includes a threaded inner portion, and wherein the second portion of the cap insert includes a second outer sleeve and a second inner sleeve concentrically disposed within the second outer sleeve, wherein each of the second outer sleeve and the second inner sleeve includes a threaded inner portion.

24. The universal bottle cap assembly of claim 23, wherein the second outer sleeve includes a third diameter and the second inner sleeve includes a fourth diameter, wherein the third diameter of the second outer sleeve is greater than the fourth diameter of the second inner sleeve.

25. The Universal bottle cap assembly of claim 24, wherein the first diameter of the first outer sleeve is equal to the third diameter of the second outer sleeve and the second diameter of the first inner sleeve is less than the fourth diameter of the second inner sleeve.

26. The universal bottle cap assembly of claim 24, wherein the cap insert includes a common wall dissecting a body of the cap insert, wherein the first outer sleeve, the first inner sleeve, the second outer sleeve, and the second inner sleeve are coupled together at the common wall of the cap insert.

27. The universal bottle cap assembly of claim 26, wherein the common wall of the cap insert defines a second aperture configured to locate a dispensing member therethrough.

28. The universal bottle cap assembly of claim 26, wherein the dispensing member includes a gasket portion and the second aperture of the common wall includes a perimeter, wherein the gasket portion of the dispensing member is configured to surround the perimeter of the second aperture to prevent unwanted flow of material between the first and second portions of the cap insert.

29. The universal bottle cap assembly of claim 26, wherein the second aperture defined in the common wall of the cap insert is aligned with the first aperture defined in the distal portion of the housing when the cap insert is disposed within the cavity of the housing.

* * * * *